United States Patent [19]

Hopwood et al.

[11] 4,193,801

[45] Mar. 18, 1980

[54] PROCESS FOR PRODUCING PHOTOGRAPHIC SILVER HALIDE MATERIAL

[75] Inventors: Howard R. Hopwood, Chelmsford; Roy Trunley, Rayleigh, both of England

[73] Assignee: Ciba-Geigy Aktiengesellschaft, Basel, Switzerland

[21] Appl. No.: 965,965

[22] Filed: Dec. 4, 1978

Related U.S. Application Data

[63] Continuation of Ser. No. 817,462, Jul. 19, 1977, abandoned.

[30] Foreign Application Priority Data

Jul. 29, 1976 [GB] United Kingdom ..... 31584/76
Jul. 29, 1976 [GB] United Kingdom ..... 31783/76

[51] Int. Cl.[2] ..... G03C 1/84; G03C 1/40

[52] U.S. Cl. ..... 430/570; 430/566; 430/600; 430/613; 430/570; 430/581

[58] Field of Search ..... 96/100 R, 97, 94 R, 96/95, 120, 130, 84 UV, 107, 109

[56] References Cited

U.S. PATENT DOCUMENTS

| | | | |
|---|---|---|---|
| 2,322,027 | 6/1943 | Jelley et al. | 96/97 |
| 2,852,381 | 9/1958 | Minsk et al. | 96/97 |
| 3,287,134 | 11/1966 | Kainrath et al. | 96/100 |
| 3,438,776 | 4/1969 | Yudelson | 96/95 |
| 3,469,987 | 9/1969 | Owens et al. | 96/130 |
| 3,676,147 | 7/1972 | Boyer et al. | 96/130 |

*Primary Examiner*—Travis Brown
*Attorney, Agent, or Firm*—Sprung, Felfe, Horn, Lynch & Kramer

[57] ABSTRACT

A method of incorporating water insoluble additives (e.g. sensitizing dyes) in colloid layers of photographic silver halide material is provided. The additives are dissolved in a fused water soluble organic compound (e.g. sorbitol or succinimide) and the resulting mixture is either directly added to an aqueous photographic emulsion or is dissolved in the minimum of water or organic solvent and this concentrated aqueous solution is then added to the aqueous photographic emulsion and the whole is then coated as a layer which is part of a photographic material.

11 Claims, No Drawings

PROCESS FOR PRODUCING PHOTOGRAPHIC SILVER HALIDE MATERIAL

This is a continuation, of application Ser. 817,462, filed July 19, 1977, now abandoned.

Usually it is required to incorporate various additives into photographic layers and in particular silver halide emulsion layers and these additives are very often water insoluble. The conventional method of incorporating water insoluble additives for example optical sensitizing dyes into photographic layers consists of dissolving the additive in an appropriate organic solvent for example methyl alcohol, ethyl alcohol or acetone, and adding the resulting solution to an aqueous photographic coating composition, as shown for example in the following references:

According to British Pat. Specification No. 1 340 108 a method of spectrally sensitizing a photographic light-sensitive emulsion is provided, which comprises dissolving a methine sensitizing or desensitizing dye in an organic solvent having a water-solubility of 10% by weight or less at 35° C., dispersing the solution in water or in an aqueous solution containing not more than 2% by weight of a hydrophilic colloid and subsequently adding the dispersion so formed to a light-sensitive emulsion.

British Pat. Specification No. 1 373 223 concerns a process for producing a spectrally-sensitized silver halide photographic emulsion which comprises dissolving at least one photographic sensitizing or desensitizing dye in a solution in water or in an aqueous organic solvent of at least one surface active agent containing a hydrophilic group selected from —$SO_3$—, —$OSO_3$— or —COO— groups and adding the resultant dye solution to a silver halide photographic emulsion to produce the spectrally-sensitized silver halide photographic emulsion. Whilst this method has provided commercially feasible means for incorporating optical sensitising dyes and other water insoluble photographic additives into photographic layers, and in particular silver halide emulsions it still requires considerable care and extra manipulative steps in adjusting the volume of solvent to quantities compatible with the particular emulsion to produce the desired results. Also it is well known that excessive solvent engenders disadvantageous diffusion or wandering of the additives in the layers. If this excessive solvent is removed before coating this requires a costly and hazardous process.

The present invention provides a method of incorporating photographic additives and in particular water insoluble additives into photographic layers of photographic material using less solvent than is usually used.

The present invention relates to a method for preparing photographic material containing coated on a photobase at least one silver halide emulsion layer which contains at least one water-insoluble photographic additive which comprises the steps of:

(a) forming a solid photographic additive composition of a water soluble organic compound having a melting point of between 30° C. and 200° C. which has dissolved or dispersed therein at least one water-insoluble photographic additive, the photographic additive or additives constituting from 1 to 80% by weight of the photographic additive composition (b) either adding the solid photographic additive composition directly to an aqueous photographic colloid composition or (c) dissolving the solid photographic additive composition in the minimum amount of water or an organic solvent and adding this concentrated solution to an aqueous photographic colloid composition and (d) coating the aqueous photographic colloid composition as a layer on a photobase and drying the composition.

It is required that the water-soluble organic compound should have no adverse photographic effect and should be water-soluble that is to say, soluble to the extent of at least 3 g/liter.

The method of the present invention is of particular use when the photographic additive is water-insoluble but can be used when the photographic additive is water-soluble.

Preferably the photographic additive is incorporated in the water soluble organic compound when this latter compound is in the molten state.

In one aspect of the invention the aqueous photographic colloid composition to which the additive is added is a photographic coating composition which is coated as a layer on a photographic base, however in another aspect of the invention the said aqueous photographic colloid composition having the additive dispersed therein is then added to an aqueous photographic colloid coating composition which is then coated as a layer on photographic base.

Therefore in a preferred aspect of the present invention there is provided a process for the preparation of photographic material which comprises the steps of forming a photographic additive composition by preparing a melt of an organic compound which is water soluble to the extent of at least 3 g/liter and which has a melting point of between 30° C. and 200° C., adding to the melt a water-insoluble photographic material additive, which is soluble or dispersable in said melt, to dissolve or disperse therein as a homogenous mixture, allowing the melt to cool to form a solid and then either adding the solid photographic additive composition directly to an aqueous photographic colloid composition or dissolving the solid photographic additive composition in the minimum amount of water or organic solvent, adding this concentrated solution to an aqueous photographic colloid coating composition, and then coating the aqueous photographic colloid coating composition as a layer on photographic base and drying the composition.

Preferably the cold solid is ground to a fine powder before it is added either directly to the aqueous photographic coating composition or to the water or organic solvent; the size of the ground particles determining the rate of dissolution of the solid.

The process of the present invention is of particular use when the aqueous photographic colloid coating composition is an aqueous gelatino silver halide emulsion coating composition. When the photographic colloid coating composition is a silver halide emulsion, examples of water insoluble additives which are often required to be added thereto are optical sensitizers, stabilizers, anti-foggants, colour couplers and acutance dyes.

In the process of the present invention when the solid photographic additive composition is dissolved in a solvent before it is added to the aqueous coating composition preferably this solvent is water and a concentrated aqueous solution is thus formed. The amount of water required depends on the water-solubility of the organic compound used as a carrier. Preferably in this alternative of the method of the present invention organic compounds which are water-soluble to the extent of at least 20 g/liter are employed. Surprisingly when the solid photographic additive composition is dissolved in water the water-insoluble photographic additive does not precipitate or aggregate but remains dispersed in the water. This solution will not keep indefinitely and preferably it is added to the aqueous photographic coating composition within a few hours of having been prepared. However the solid photographic additive composition is quite stable and may be prepared weeks before it is required to be used.

When an organic compound which is less water-soluble than 20 g/liter is employed it is preferred to dissolve the solid photographic additive composition in an organic solvent for example ethanol or acetone. However in this case very much less organic solvent is required than if the photographic additive were dissolved initially therein and added to the aqueous photographic coating composition.

The invention is of especial use when the additive is an optical sensitizing dye. Most optical sensitizing dyes are highly water-insoluble. Optical sensitizing dyes are usually added to aqueous silver halide emulsions, for adsorption on to silver halide crystals, by dissolving them in ethanol or other simple alcohols, adding the alcoholic solution to the emulsion and then either leaving the alcohol in the aqueous silver halide emulsion or removing the alcohol, which is difficult. However if there is already present in the silver halide emulsion colour couplers dissolved in oil dispersions often the alcohol leaches out the colour couplers from the dispersion causing the colour couplers to crystallize. Also the need to produce very concentrated silver halide emulsion for coating by high speed processes such as cascade coating means that the emulsion should not be diluted by the addition of sensitizing dyes dissolved in solvents such as alcohol. However by means of the process of the present invention it is possible to add optical sensitizing dyes in a highly concentrated form to aqueous silver halide emulsions. When the concentrated solution of the photographic additive composition which comprises the optical sensitizing dye is added to the silver halide emulsion, the dye becomes dispersed throughout the emulsion in such a form that it can become adsorbed by the silver halide crystals.

In another aspect of the process of the present invention the layer prepared by the process is a non-light-sensitive colloid layer, preferably a gelatin layer, which may be an inter-layer between emulsion layers, a supercoat layer, an underlayer or a backing layer. If the colloid layer is a supercoat layer the additive may be for example an optical brightening agent or a U.V. Absorber. If the colloid layer is an interlayer the additive may be for example an acutance dye or a filter dye. If the colloid layer is an under layer the additive may be for example, a bleachable anti-halation dye. If the colloid layer is the backing layer the additive may be for example an anti-halation dye.

Suitable water-soluble organic compounds having a melting point between 30° C. and 200° C. of use in preparing the photographic additive composition used in the process of the present invention belong to the following classes of compounds:-

(a) derivatives, particularly alkyl derivatives, of urea and thiourea, preferably those of the formula

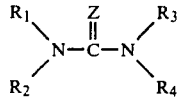

(1)

wherein $R_1$, $R_2$, $R_3$ and $R_4$ each independently represent alkyl having 1 to 4 carbon atoms, optionally substituted by hydroxyl, cycloalkyl or phenyl; tolyl, which is optionally substituted with OH-groups; and wherein $R_1$, $R_2$ and $R_3$ can also be hydrogen; and Z represents oxygen or sulphur. The following examples may be given: N-ethylurea, N-butylurea; N-(3-tolyl)-urea, N,N'-dimethylurea, N,N'-bis-(hydroxy-methyl)-urea, N,N'-ethyleneurea, N-methylthiourea, N,N'-dimethylthio-urea, N-ethyl-N-phenylurea and N-hydroxymethylurea.

(b) saturated and unsaturated mono- and dicarboxylic acid amides, particularly those of formula (2) $R—CO—NH_2$ or (3) $R—(CONH_2)_2$ wherein R represents an alkyl or alkylene radical having 1 to 6 carbon atoms, or the group $—CH=CH—$, $CH_2=CH—$ or $CH_3CH=CH—$, also phenyl or tolyl, also heterocyclic saturated and/or unsaturated 5- or 6-membered ring having at least one N, O, S, CO or NH in the ring, whereby the symbol R can optionally be substituted also by OH, $NH_2$, halogen or hydroxyalkyl having 1 to 3 carbon atoms. The acid amides are, for example, acetamide, chloroacetamide, nicotinic acid amide and benzamide.

(c) lactams such as δ-valerolactam, ε-caprolactam and oenantholactam;

(d) acid imides or derivatives of acid imides, especially those of the general formula.

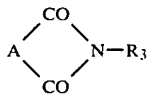

(4)

wherein A represent $—CH=CH—$ or $(CH_2)_n$, wherein n is 1 to 6, and A can optionally be substituted by OH, $NH_2$, halogen, hydroxyalkyl ($C_1$–$C_3$) groups, and $R_3$ represents H, OH or hydroxyalkyl ($C_1$–$C_3$), examples of these are: succinimide, maleinimide and N-hydroxysuccinimide;

(e) oximes such as acetoneoxime, cyclohexanoneoxime and diacetylmonoxime;

(f) saturated and unsaturated 5- or 6-membered heterocyclic compounds which contain in the ring O, S, CO and NH, and which can optionally be substituted with OH, $NH_2$, halogen, alkyl ($C_1$–$C_4$), phenyl, hydroxyalkyl ($C_1$–$C_3$) - groups, such as symmetrical trioxane, imidazole, 2-methylimidazole, pyrazole, pyrazine, 2,3-dimethyl-1-phenyl-5-pyrazolone, and 1,2,4-triazole;

(g) aliphatic or aromatic, at least bivalent alcohols, such as 2,2-dimethyl- and 2,2-diethylpropanediol-1,3; dihydroxyacetone, o-xylylene glycol, erythrite, D-fructose, maltose, xylite, sorbitol and mannitol;

(h) polyalkylene glycols, such as polyethylene glycol preferably having a molecular weight of 1,000 to 20,000, especially those of the formula

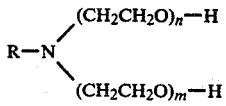

(5)

wherein R represents a saturated or unsaturated alkyl radical having 9 to 30 carbon atoms, and n and m each represents the numbers 3 to 200;

(i) carbamic acid esters, such as carbamic acid methyl ester, carbamic acid ethyl ester, and carbamic acid propyl ester.

(j) derivatives of benzene, particularly those of the general formula

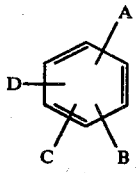

(6)

wherein A, B, C and D each independently represent OH, halogen, alkyl, hydroxyalkyl and alkoxy having 1 to 3 carbon atoms; and wherein A, B and C can be hydrogen; the following may for example be mentioned; 1,4-dihyroxybenzene 2,6-dihydroxytoluene, 2,3-dihydroxytoluene, 2,4- dimethyl-1,5-dihydroxybenzene, 4,5-dimethyl-1,2-dihydroxybenzene, 3,5-dimethyl-1,2-dihydroxybenzene, 1,2-bis-(hydroxymethyl)-benzene, 1,3-bis(hydroxymethyl)-benzene, 1,4-bis-(hydroxymethyl)-benzene, 2-chloro-1,4-dihydroxybenzene, 4-chloro-1,2-dihydroxybenzene, 1-chloro-2,4,-di-hydroxybenzene, 1-chloro-3,5-dihydroxybenzene, 1-chloro-2,5-dimethyl-4-hydroxybenzene and 1-chloro-4,5-dimethyl-2-hydroxybenzene.

The most preferred classes of compounds for use in the present invention are the acid imides of (d) as hereinbefore set forth and the aliphatic at least bivalent alcohols of (g).

Two compounds of especial use are succinimide and sorbitol. Both of these compounds can be considered as very water-soluble, sorbitol having a solubility 830 g/liter at 20° C. and succinimide having a solubility of 333 g/liter at 20° C. Sometimes in order to produce the correct melt conditions in which to dissolve or disperse the photographic additive it is preferable to use mixtures of the above listed water-soluble compounds having a melting point of between 30° and 200° C.

Preferably there is present in the solid photographic additive composition prepared and used in the present invention a surfactant which may be of an anionic and/or non-ionic nature. The presence of the surfactant tends to improve the dispersibility of the optical sensitizing dye or other photographic additive both in the concentrated solvent solution (if prepared) and in the aqueous coating composition.

The non-ionic surfactants of use are, in particular, polyglycol ethers such as alkyl-polyglycol ether or alkylphenolpolyglycol ether, for example, octylphenolpolyglycol ether and fatty acid polyglycol esters. Suitable anionic surfactants are e.g. the most varied sulphates, for example, sulphated primary aliphatic alcohols having 10 to 18 carbon atoms, such as sodium decyl sulphate, sodium lauryl sulphate, sodium myristyl sulphate and sodium oleyl sulphate or sulphated secondary aliphatic alcohols; also sulphated unsaturated fatty acids, fatty acid polyglycol ethers or sulphated fatty acid amides, sulphated alkyleneoxy adducts, sulphated partially esterified polyvalent alcohols; and, in particular, the sulphonates such as alkylsulphonates, for example, laurylsulphonate, cetylsulphonate, stearylsulphonate, petroleum sulphonates, naphthensulphonates, olefinsulphonates, mersolates, sodium dialkylsulphosuccinates such as sodium dioctylsulphosuccinate and taurides, for example, oleyl methyl tauride (sodium salt), alkylarylsulphonates such as alkylbenzensulphonates having a straight-chain or branched alkyl chain containing about 7 to 10 carbon atoms and mono- and dialkylnaphthalenesulphonates such as nonylbenzenesulphonate, dodecylbenzenesulphonate and hexadecylbenzenesulphonate, as well as 1-isopropylnaphthalene-2-sulphonate, di-iso-propylnaphthalene-sulphonate, di-n-butylnaphthalenesulphonate, di-iso-butylnaphthalenesulphonate; condensation products from naphthalenesulphonic acid and formaldehyde, such as dinaphthylmethanedisulphonate, also lignin sulphonates and oxylignin sulphonates of polycarboxylic acid esters and polycarboxylic acid amides, and condensation products of fatty acids with aminoalkylsulphonates, also phosphated surfactants such as mono-and diphosphate esters of oxethylated fatty alcohols, alkylphenols and fatty acids.

In the preferred method of the present invention the photographic additive composition is prepared by heating the solid water-soluble organic compound having a melting point of between 30° C. and 200° C. to form a melt thereof, adding the photographic additive thereto as a finely divided solid together with the surfactant (s) if used, stirring to obtain a homogeneous dispersion or solution of the additive in the melt material, allowing to cool to a solid which is mechanically reduced to the preferred particle size.

However it is possible to dissolve the photographic additive in an organic solvent, add the organic compound thereto remove the solvent by vacuum distillation to form a melt which can then be processed as before. In some cases the photographic additive can be dissolved in a water-miscible organic solvent and this solution is then added to an aqueous solution of the organic compound, the water and organic solvent are then removed by vacuum distillation to prepare the melt which is processed as before.

Preferably the photographic additive composition of use in the process of the present invention comprises 1 to 30% by weight of the photographic additive and 1 to 10% by weight of the surfactant.

The process of the present invention is of particular use in dispersing optical sensitising dyes in photographic emulsions and therefore according to an especially preferred aspect of the present invention there is provided a process for the preparation of photographic material which comprises the steps of forming a photographic additive composition by preparing a melt of a solid which is water soluble to the extent of at least 3 g/liter and which has a melting point of between 30° C. and 200° C., adding to the melt an optical sensitising dye which is soluble or dispersible in said melt, to dissolve or disperse therein as a homogenous mixture, allowing the melt to cool to form a solid, and then either adding the solid containing the sensitising dye to an aqueous silver halide emulsion or dissolving the solid containing the optical sensitising dye in the minimum amount of water, adding this concentrated solution to an aqueous silver halide emulsion, and then coating the aqueous silver halide emulsion as a layer on photographic base and drying the composition.

In an alternative method relating to this aspect of the present invention there is provided a process for the preparation of photographic material which comprises the steps of forming a photographic additive composition by preparing a melt of a solid which is water soluble to the extent of at least 3 g/liter and which has a melting point of between 30° C. and 200° C., adding to the melt an optical sensitising dye which is soluble or dispersible in said melt, to dissolve or disperse therein as a homogenous mixture, allowing the melt to cool to form a solid and then either adding the solid containing the optical sensitising dye to an aqueous gelatin solution or dissolving the solid containing the optical sensitizing dye in the minimum of water, adding this concentrated solution to an aqueous gelatin solution and then dispersing the aqueous gelatin solution in an aqueous silver halide emulsion and coating the aqueous silver halide emulsion as a layer on photographic base and drying the composition.

These processes are applicable to sensitising dyes which have the solubility in water (at 20° C.) of less than 0.1 percent by weight. Among the useful optical sensitising dyes are the cyanine dyes, the hemicyanine or merocyanine dyes and the styryl dyes and oxonol dyes and other dyes containing the amidinium ion auxochromophore system, such as rhodamine, pinacyanol and pinaflavol. Preferably in this aspect of the present invention there is added to the melt up to 10% by weight of a surfactant.

As hereinbefore stated the process of this invention can also be used for other dyes, colourants, antifoggants, stabilisers colour couplers, hardeners, optical brighteners and coating aids which are difficultly soluble in conventional solvents, and to other photographic additives which despite being soluble in conventional solvents are desired to be formed into higher concentration solutions.

The photographic layer prepared in the process of the present invention is usually a photosensitive silver halide layer but it may be for example a supercoat or protective layer, an interlayer and in particular a filter layer, an undercoat layer or a backing layer. If the layer prepared is a silver halide layer this layer may comprise any silver halide composition for example silver chloride, silver bromide, silver iodide and mixed halide such as chlorobromide and iodobromide. The silver halide layers may of course contain other additives for example chemical sensitisers such as noble metals, sulphur compounds and polyalkylene oxides, coating aids and sequestering agents.

The photographic material produced by the process of the present invention may be any photographic material for example black and white camera film and graphic arts films, black and white paper, colour films and paper X-ray films.

EXAMPLE 1

A gold sensitized silver iodo-bromide gelatino emulsion containing 8.8 mole% of silver iodide was stabilized with an aqueous solution of 4-hydroxy-6-methyl-1,3,3a-7-tetrazaindene and divided into two portions. Each portion of emulsion was spectrally sensitized using the mixture of two parts of the sensitizer of formula (101) and one part of the sensitizer of formula (102)

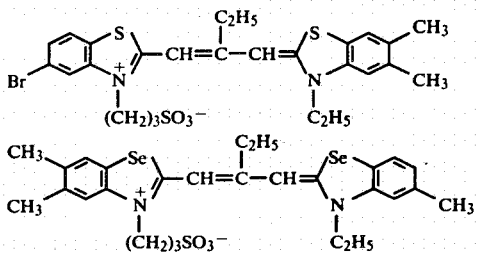

(a) To 380 mg of molten sorbitol was added 20 mg of the mixture of the sensitizers to form a melt. This dye melt was cooled and then ground up to fine particles. The 400 mg of photographic additive composition was added to 100 g of the above mentioned emulsion to prepare sample (a).

(b) To 20 mg of the mixture of the sensitizers was added ethanol to form a dye solution. The amount of ethanol required to completely dissolve the dye was 39 ml. This dye solution was added to 100 g of the second portion of the above mentioned emulsion to prepare a control sample (b).

To each emulsion portion was added a phenolic cyan dye forming coupler dispersed in a high boiling solvent.

The coupler used was 2-{4-[2,4-Bis(1,1-dimethylpropyl)phenoxy]butylcarbamoyl}-1-naphthol in tritolyl phosphate at a ratio of coupler to oil of 1:1. The coupler was added to the emulsion at the rate of 1 g of coupler per 2 g of silver.

The emulsion portions were then coated on a support base. These photographic coatings were exposed for 1/30th second through an ILFORD 204 filter and processed by a colour negative process which comprises a developing solution, a bleaching solution, a fixing solution and a stabilising solution.

The process used is as follows:

Developer

| Constituents | Fresh Tank Solution Formulation |
|---|---|
| Water at 21° C. to 27° C. | 800 ml |
| Potassium Carbonate (Anhydrous) | 37.5 gms |
| Sodium Sulphite (Anhydrous) | 4.25 g |
| Potassium Iodine | 2.0 mg |
| Sodium Bromide | 1.3 g |
| Hydroxylamine Sulphate | 2.0 g |
| Sodium hexametaphosphate | 2.5 g |
| 4-Amino-3-methyl-N-ethyl-N-hydroxyethyl aniline-sulphate | 4.75 g |
| Water to make | 1 litre |
| pH at 27° C. | 10.00 ± 0.03 |

Bleach

| Constituents | Fresh Tank Solution Formulation |
|---|---|
| Water at 21° C. to 27° C. | 600 ml |
| Ammonium Bromide | 150 g |
| Ferric Ammonium E.D.T.A. (1.56 molar) | 175 ml |
| Acetic Acid (GLACIAL) | 10.5 ml |
| Sodium Nitrate | 35 g |
| Water to make | 1 litre |
| pH at 27° C. | 6.00 ± 0.20 |

Fixer

Fresh Working Solution

-continued

| Constituents | Formulation |
|---|---|
| Water at 21° C. to 27° C. | 800 ml |
| Ammonium Thiosulphate (50% soln.) | 162 ml |
| Ethylenedinitrilo Tetraacetic Acid Disodium Salt | 1.25 g |
| Sodium Bisulphite (Anhydrous) | 12.4 g |
| Sodium Hydroxide | 2.4 g |
| Water to make | 1 litre |
| pH at 27° C. | 6.50 ± 0.20 |
| Stabiliser | |

| Constituents | Fresh Working Solution Formulation |
|---|---|
| Water at 21° C. to 27° C. | 800 ml |
| Formalin (37% solution) | 5.0 ml |
| Wetting agent | 0.8 ml |
| Water to make | 1 litre |

The process is carried out as follows:

| Solution/Procedure | Remarks | Temp. °C. | Time in Mins |
|---|---|---|---|
| 1 Developer | Total Darkness | 37.8 ± 0.2 | 3¼ |
| 2 Bleach | Total Darkness | 37.8 ± 3 | 6½ |
| 3 Wash | Room Lighting | 37.8 ± 3 | 3¼ |
| 4 Fixer | Room Lighting | 24–41 | 6½ |
| 5 Wash | Room Lighting | 37.8 ± 3 | 3¼ |
| 6 Stabiliser | Room Lighting | 24–41 | 1½ |
| 7 Dry | Room Lighting | 24–41 | 10–20 |

The following results were obtained.

Table 1

| | Speed | Fog | Sens Max. nm. |
|---|---|---|---|
| (a) Present invention | 100 | .15 | 650 |
| (b) Control | 100 | .15 | 650 |

Table 1 shows that sample (a) according to the process of the present invention is by no means inferior to the control. (b) However far better coating quality was obtained using the present invention because the presence of alcohol causes local dehydration which results in particulate matter, which is difficult to redisperse. This particulate matter remains in the composition causing coating defects such as streaks and spots. Such streaks were observed in sample (b) but none in sample (a).

EXAMPLE 2

Two further portions of the emulsion used in Example 1 were treated in entirely the same manner as in Example 1, except that one portion was spectrally sensitized by addition of 6 parts of the sensitizer of the formula (103) 3 parts of the sensitizer of the formula (104) and 1 part of the sensitizer of the formula (105).

In sample (d) 20 mg of the mixture of sensitizers was dissolved in 380 mg of sorbitol and in sample (e) 20 mg of the mixture of sensitizers was dissolved in 39 ml of ethyl alcohol.

(103)

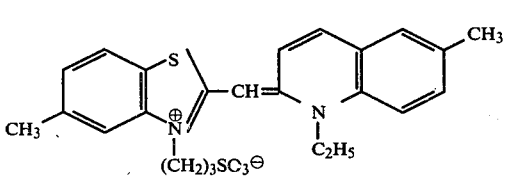

-continued (104)

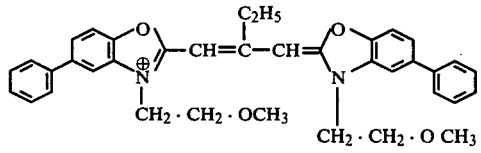

(105)

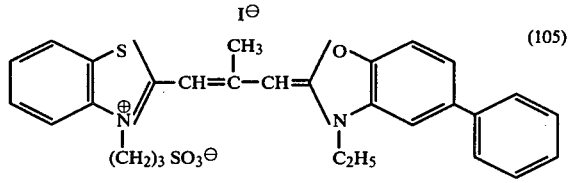

The results were as shown in table 2.

Table 2

| Sample | Speed | Fog | Sens Max. |
|---|---|---|---|
| (d) Present process | 100 | .18 | 530 & 550 |
| (e) Conventional process | 100 | .18 | 530 & 550 |

As can be seen from Table 2 no difference exists in photographic properties between the present invention and the conventional process. However the method of the invention gave better coating quality.

EXAMPLE 3

A gelatino silver bromoiodide emulsion was prepared and sensitised using a mixture of a labile sulphur compound and a soluble gold salt, and then divided into two portions. These portions were spectrally sensitised in the 500 nm to 600 nm region as follows.

(a) A 0.05% solution of the sensitizer of the formula (106) in ethyl alcohol was added to the aqueous emulsion with agitation at the rate of 0.166 g of dye per mole of silver halide.

(b) The sensitizer of the formula (106) was predissolved in sorbitol as follows. 95 parts of sorbitol was melted in a beaker. To this melt was added 5 parts of the sensitizer of formula (106) at 120° C. with stirring. After about five minutes the dye was dissolved in the melt. The melt was then poured onto a metal tray and allowed to solidify. The solid was then ground up to give a powder. This 5% dye-melt was then added to the aqueous emulsion with agitation at the rate of 0.166 g of dye per mole of silver halide.

(106)

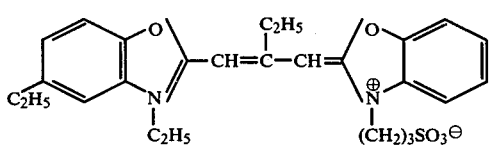

Each emulsion was further treated by addition of a magenta-forming coupler of the pyrazolone type suitably dispersed in a high boiling point solvent. The emulsions were then coated on a support. The resulting coatings were exposed for 1/30th second to a daylight exposure modified using an ILFORD 108 filter and processed by the colour negative process details of which are set forth in Example 1.

The coupler used in Examples 3 to 6 is 3-{3-[(2,4-Bis[1,1-dimethylpropyl]phenoxy)acetamido]benzamido}1-2(2,4,6-trichlorophenyl)-2-pyrazolin-5-one in tritolyl phosphate at a ratio of coupler to oil of 1:1. The coupler is added to the emulsion at the rate of 1 g of coupler per 2 g of silver.

The following results were obtained.

| Feature | Coating Observation | Relative Speed | Minimum Density | Maximum Density |
|---|---|---|---|---|
| Sensitised as in (a) | Coating streaks | 100 | .28 | 1.48 |
| Sensitised as in (b) | Good Quality | 100 | .28 | 1.66 |

As can be seen from the above table the speed and fog were unaffected but maximum density was increased due to the absence of ethanol.

EXAMPLE 4

A gelatino silver bromoiodide emulsion digested to optimum sensitivity with a mixture of a labile sulphur compound and a soluble gold salt was divided into two portions. These portions were optically sensitized in the 500 nm to 600 nm region as follows.

(c) With the sensitizer of formula (106)(preparation according to Example 3a).

(d) The sensitizer of formula (106) was predissolved in succinimide as follows. 85 parts of succinimide were melted in a beaker. To this melt was added 10 parts of sodium dodecyl benzene sulphonate with stirring and then 5 parts of the sensitizer at 130° C. with stirring. After about five minutes the dye was dissolved. The melt was then treated as in Example 3(b) and added to the aqueous emulsion at the rate of 0.166 g of dye per mole of silver halide.

Each emulsion was then treated, coated, exposed and processed as in Example 3. The following results were obtained.

| Feature | Coating Observation | Relative Speed | Minimum Density | Maximum Density |
|---|---|---|---|---|
| Sensitised as in (c) | Coating streaks | 100 | .28 | 1.48 |
| Sensitised as in (d) | Good Quality | 140 | .31 | 1.66 |

The above results show an increase in sensitized speed and maximum density accompanied by a small fog increase.

EXAMPLE 5

A negative speed gelatino silver bromoiodide emulsion digested to optimum sensitivity with a mixture of a labile sulphur compound and a soluble gold salt was divided into two portions. These portions were optically sensitised in the 500 nm to 650 nm region as follows.

(e) The sensitizer of the formula (107) was added slowly to the emulsion with good agitation from ethanol solution at the rate of 0.21 g of dye per mole of silver halide.

(f) The sensitizer of the formula (107) was predissolved in succinimide in the presence of sodium dodecyl benzene sulphonate as in Example 4(d). The melt was then treated as in Example 3(b) and added to the emulsion at the rate of 0.21 g of dye per mole of silver halide.

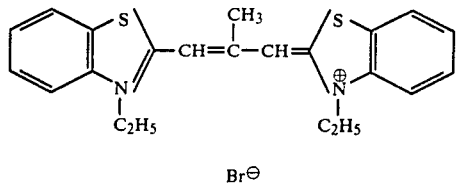

(107)

Each emulsion was then treated, coated, exposed and processed as in example 3. The following results were obtained.

| Feature | Coating Observation | Relative Speed | Minimum Density | Maximum Density |
|---|---|---|---|---|
| Sensitised as in (e) | Coating Streaks | 100 | .24 | 1.49 |
| Sensitised as in (f) | Good Quality | 100 | .22 | 1.61 |

These results show an increase in maximum density and a small reduction in fog whilst maintaining equal sensitivity.

EXAMPLE 6

A gelatino silver bromoiodide emulsion was prepared and digested to optimum sensitivity with a labile sulphur compound and a soluble gold salt and was then divided into two portions. These portions were optically sensitised in the 500 nm to 600 nm region as follows.

(g) The sensitizer of the formula (108) was added slowly to the emulsion with good agitation from ethanol solution at the rate of 0.20 g of dye per mole of silver halide.

(h) The sensitizer of the formula (108) was predissolved in succinimide in the presence of sodium dodecyl benzene sulphonate as in Example 4(d). The melt was then treated as in Example 3(b) and added to the emulsion at the rate of 0.20 g of dye per mole of silver halide.

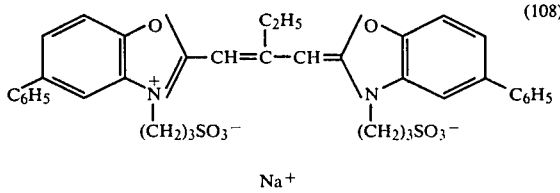

(108)

Each emulsion was then treated, coated, exposed and processed as in Example 3. The following results were obtained.

| Feature | Coating Observation | Relative Speed | Minimum Density | Maximum Density |
|---|---|---|---|---|
| Sensitised as in (g) | Coating Streaks | 100 | .26 | 1.51 |
| Sensitised as in (h) | Good Quality | 100 | .26 | 1.70 |

These results show an increase in maximum density with no increase in fog for equal sensitivity The Dmax and contrast increases in Examples 3 to 6 can be explained as follows. The presence of ethanol in a coated layer can cause the coupler to be leached out of the oil in which it is dispersed, because the coupler is slightly soluble in ethanol. Therefore, when the layer is dried, the coupler which has been leached out, precipitates in the coated layer. The precipitated coupler is then no longer efficient at producing image dye, giving a loss in Dmax and contrast. The method of the present invention gives no such defect, giving higher Dmax and contrast.

EXAMPLE 7

This example serves to show the use of the present invention for introducing additives other than optical sensitizing dyes with photographic material. The additive used is a photographic silver halide emulsion stabilizer 4-hydroxy-6-methyl-1,3,3a,7-tetra-azaindene.

Often it is desired that concentrated aqueous solutions of photographic additives are prepared in bulk and stored and then added to the silver halide emulsion whilst the emulsion is being prepared. However solutions of 4-hydroxy-6-methyl-1,3,3a,7-tetraazaindene greater in strength than 1% weight per volume in water are unsuitable and precipitate if stored for more than three days. It is preferred to add a more concentrated aqueous solution than a 1% solution of this additive to the silver halide emulsion during preparation.

A melt containing the additives was prepared as follows: 85 g of succinimide were melted in a beaker. To this melt were added 10 g of sodium dodecyl benzene sulphonate with stirring and then 5 g of the additive at 130° C. with stirring. The additive dissolved in the melt within 5 minutes. The melt was then poured onto a metal tray and allowed to solidify. The solid was then ground up to yield a powder. This powder could be stored without any apparent deterioration of the stabilizer.

In Example 1 as hereinbefore set forth the silver halide emulsion was stabilised with an aqueous solution of a 4-hydroxy-6-methyl-1,3,3a,7-tetrazaindene. Example 1 was repeated using instead of the aqueous solution of the stabilizer the powder containing the stabilizer as just prepared, the same amount of stabilizer (1.3 g per gram mole of silver halide) being added. The emulsion obtained was perfectly satisfactory and no change in the stabilizing effect of the stabilizer was observed.

As the composition made according to the present process is far more concentrated (at least five times) than in the case of the aqueous solution, when the stabilizer is added to the emulsion, the emulsion is not diluted as much using the present process. This means a highly concentrated light sensitive photographic emulsion layer can be coated.

EXAMPLE 8

This Example illustrates the alternative procedure of dissolving the solid photographic additive composition in water to form a concentrated solution and then adding this concentrated solution to the aqueous coating composition.

A high speed aqueous gelatino silver bromoiodide emulsion was sensitised using a mixture of a labile sulphur compound and a soluble gold salt, and divided into two portions. These portions were spectrally sensitised in the 550 nm to 600 nm region as follows:

(a) A 0.05% solution of the sensitizer of formula (105) in ethyl alcohol was added to the aqueous emulsion with agitation at the rate of 0.166 g per mole of silver halide.

(b) The sensitizer of formula (105) was predissolved in succinimide as follows -

85 parts of succinimide are melted in a beaker. To this melt is added 10 parts of sodium dodecyl benzene sulphonate with stirring and then 5 parts of the sensitizer at about 130° C. with stirring. After about five minutes the dye is dissolved. The melt is then poured on to a metal tray and allowed to solidify. The solid is then ground up to give a powder. This 5% powdered melt is then added to water with stirring to give a 0.05% dispersion of the sensitizer. This dye dispersion is then added immediately to the aqueous silver halide emulsion with agitation at the rate of 0.166 g of dye per mole of silver halide.

Each emulsion was further treated by addition of the following cyan-forming coupler 2-{4-[2,4-Bis(1,1-dimethylpropyl)phenoxy]butylcarbamoyl}-1-naphthol dispersed in tritolyl phosphate at a ratio of coupler to oil of 1:1. The aqueous silver halide emulsions were then coated on a support. The resulting coatings were exposed for 1/30th second to a daylight exposure modified using an ILFORD 108 filter (yellow) and processed by the colour negative process which comprises a developing solution, a bleaching solution, a fixing solution and a stabilizing solution as set forth in Example 4. The following results were obtained:

| Feature | Comments on Coating | Relative Speed | Minimum Density | Maximum Density |
|---|---|---|---|---|
| Sensitised as in (a) | Coating streaks | 100 | .18 | 1.25 |
| Sensitised as in (b) | Good quality | 100 | .18 | 1.40 |

As can be seen from the above table, the speed and fog were unaffected, but the maximum density was increased due to the absence of ethanol.

This shows that the alternative method wherein the solid additive composition is dissolved in a solvent to form a concentrated solution is also leads to an improved coated photographic silver halide emulsion material.

What we claim is:

1. A process for preparing photographic material containing coated on a photobase at least one silver halide emulsion layer which contains at least one water-insoluble photographic additive selected from the groups consisting of optical sensitizing dyes, stabilizers, anti-foggants, color couplers and acutance dyes which process comprises the steps of:

(a) forming the photographic additive composition by preparing a melt of an organic compound which is water soluble to the extent of at least 3 g/litre and which has a melting point of between 30° C. and 200° C., adding to the melt the water-insoluble photographic additive, which consititutes from 1 to 80% by weight of the photographic additive composition, and which additive is soluble in said melt, to dissolve therein and allowing the melt to cool to form a solid, the water-soluble organic compound being an acid imide or its derivative of the formula

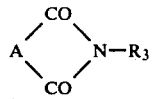

wherein A represents —CH=CH— or $(CH_2)_n$, n is 1 to 6, A is optionally substituted by OH, $NH_2$, halogen, hydroxyalkyl of 1 to 3 carbon atoms and $R_3$ represents H, OH or hydroxyalkyl of 1 to 3 carbon atoms or erythrite, D-fructose, maltose, xylite, sorbitol and mannitol, (b) either adding the solid photographic additive composition directly to an aqueous gelatino silver halide or (c) dissolving the solid photographic additive composition in the minimum amount of water or an organic solvent and adding this concentrated solution to a gelatino silver halide emulsion and (d) coating the aqueous gelatino silver halide emulsion as a layer on a photographic base and drying the layer.

2. A process according to claim 1 wherein the solid photographic additive composition is ground to a fine powder before it is added either to the aqueous photographic colloid composition or to the water or organic solvent.

3. A process according to claim 1 wherein the aqueous photographic coating composition is an aqueous non-light sensitive colloid composition which forms an inter-layer, super-coat layer or backing layer on the coated photographic material.

4. A process according to claim 1 wherein the water-soluble organic compound having a melting point between 30° C. and 200° C. is succinimide or sorbitol.

5. A process according to claim 1 wherein the solid photographic additive composition comprises an anionic and/or a non-ionic surfactant.

6. A process according to claim 5 wherein the non-ionic surfactants are polyglycol ethers, alkylphenol-polyglycol ether or fatty acid polyglycol esters and the anionic surfactants are sulphated primary aliphatic alcohols having 10 to 18 carbon atoms, sulphated secondary aliphatic alcohols, sulphated unsaturated fatty acids, fatty acid polyglycol ethers, sulphated fatty acid amides, sulphated alkylenoxy adducts, sulphated partially esterified polyvalent alcohols, alkylsulphonates, sodium dialkylsulpho-succinates, taurides, alkylarylsulphonates, condensation products from naphthalene-sulphonic acid and formaldehyde, lignin sulphonates and oxylignin sulphonates of polycarboxylic acid esters and polycarboxylic acid amides, condensation products of fatty acids with aminoalkylsulphonates, and mono- and diphosphate esters of oxethylated fatty alcohols, alkylphenols and fatty acids.

7. A process according to claim 1 wherein step (a) is carried out by heating the solid water-soluble organic compound having a melting point of between 30° C. and 200° C. to form a melt thereof, adding the photographic additive as a finely divided solid and optionally the surfactant(s) thereto, stirring to obtain a homogeneous dispersion or solution of the additive in the melt material, allowing to cool to a solid and mechanically reducing to the preferred particle size.

8. A process according to claim 5 wherein the solid photographic additive composition comprises 1 to 30% by weight of the photographic additive and 1 to 10% by weight of the surfactant.

9. A process for the preparation of photographic material according to claim 1 wherein the photographic additive is an optical sensitizing dye and the aqueous photographic colloid composition is an aqueous silver halide emulsion.

10. A process for the preparation of photographic material according to claim 1 which comprises the steps of (a) forming the photographic additive composition by preparing a melt of a solid organic compound which is water soluble to the extent of at least 3 g/litre and which has a melting point of between 30° and 200° C., adding to the melt an optical sensitizing dye which is soluble in said melt, to dissolve therein and allowing the melt to cool to form a solid, the solid organic compound being an acid imide or its derivative of the formula

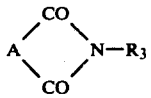

wherein A represents —CH=CH— or $(CH_2)_n$, n is 1 to 6, A is optionally substituted by OH, $NH_2$, halogen, hydroxyalkyl of 1 to 3 carbon atoms and $R_3$ represents H, OH or hydroxylalkyl of 1 to 3 carbon atoms or erythrite, D-fructose, maltose, xylite, sorbitol and mannitol, (b) either adding the solid containing the optical sensitizing dye to an aqueous gelatin solution or (c) dissolving the solid containing the optical sensitizing dye in the minimum of water, adding this concentrated solution to an aqueous gelatin solution, and then dispersing the aqueous gelatin solution in an aqueous silver halide emulsion and (d) coating the aqueous silver halide emulsion as a layer on a photographic base and drying the layer.

11. Photographic silver halide material obtained according to the process of claim 1.

* * * * *